United States Patent [19]

Lengacher

[11] Patent Number: 4,867,406

[45] Date of Patent: Sep. 19, 1989

[54] VERTICALLY ADJUSTABLE CHAIR SUPPORT

[76] Inventor: Eli Lengacher, 17305 Grabill Rd., Grabill, Ind. 46741

[21] Appl. No.: 254,615

[22] Filed: Oct. 7, 1988

[51] Int. Cl.[4] ..... F16M 11/00

[52] U.S. Cl. ..... 248/409; 248/125

[58] Field of Search ..... 248/407, 408, 409, 125, 248/354.4, 354.5, 354.7; 297/437, 345, 346, 347; 108/144, 146

[56] References Cited

U.S. PATENT DOCUMENTS

| | | | |
|---|---|---|---|
| 1,609,246 | 11/1926 | Hamburger | 248/407 |
| 2,530,877 | 11/1950 | Heck et al. | 248/408 X |
| 2,659,413 | 11/1953 | Cramer | 297/437 |
| 3,327,985 | 6/1967 | Levit et al. | 248/408 |
| 3,770,236 | 11/1973 | Marsh | 248/408 |

FOREIGN PATENT DOCUMENTS

| | | | |
|---|---|---|---|
| 256497 | 7/1962 | Australia | 248/409 |
| 528023 | 7/1956 | Canada | 248/409 |

*Primary Examiner*—J. Franklin Foss
*Attorney, Agent, or Firm*—Roger M. Rickert

[57] ABSTRACT

A vertically adjustable seat support arrangement for a chair, stool or the like having a lower pedestal, and an upper seat, the seat support arrangement including a vertical elongated tubular member having a lower end fixed to and supported by the pedestal, an elongated support post formed as a symmetrical solid of revolution about a central axis, said support post telescopically received within and vertically movable relative to the tubular member, the support post having an upper end fixed to the seat, a locking mechanism including a locking pin selectively movable transversely between a post locking position where the pin extends through a sidewall of the tubular member and engages the post and a post releasing position where the post may be moved vertically relative to the tubular member, a sleeve through which the post passes, the sleeve fixed within the tubular member serving as a side thrust bearing and post stop for preventing post travel beyond a predetermined maximum seat elevation, spring bias means for urging the locking pin toward the post locking position, and a lever for moving the locking pin against the spring bias to free the post allowing vertical seat adjustment relative to the pedestal, means for limiting locking pin motion to rectilinear motion toward and away from the post.

10 Claims, 1 Drawing Sheet

VERTICALLY ADJUSTABLE CHAIR SUPPORT

SUMMARY OF THE INVENTION

The present invention relates generally to support columns used in chairs, stools and the like to provide a measure of vertical adjustability to the chair or stool while securely locking the chair or stool at a selected height.

A wide variety of vertically adjustable seat support assemblies for chairs, stools and the like have been devised. One illustrative arrangement includes a tubular member having its lower end fixed to a pedestal or base and telescopically receiving a support post which is vertically movable therein. The upper end of the support post is fixed to the seat of the chair or stool. Such a post typically has a plurality of spaced holes for receiving a locking pin to hold the post and thus the seat at a preferred elevation. U.S. Pat. No. 3,770,236 is typical of this type adjustable chair support. In this patented arrangement, a keyway must be milled along the post, or some other scheme employed to prevent the post or shaft from rotating about its vertical axis while the locking pin is temporarily withdrawn, thereby misaligning the shaft holes and locking pin. Such an operation is an expensive and time consuming operation. The crossboring of the several shaft holes is also an expensive and time consuming operation. It is also known to provide an adjustable chair support column with a series of flat milled notches each having a flat sloping cam surface and a spring-loaded latching device for engaging the notches to allow the chair to be raised while preventing it from being inadvertently dropped or lowered. Illustrative of the latter type arrangement are U.S. Pat. Nos. 2,542,480; 2,939,514; 3,327,985; and 3,443,734. It is imperative that the post not rotate relative to the sleeve and latching device in this type arrangement since such relative rotation would dislodge the latching mechanism and/or prevent it from latching. In either case, the seat will immediately be dropped to its lowermost position.

Lathe cut annular notches in a shaft of a dissimilar adjustable height device are known as shown by the automobile radiator repair stand of the Clement U.S. Pat. No. 1,732,081. This patent is silent on rotation about a vertical axis and raising of the device without withdrawing the latching mechanism. The post of this device is not a true solid of revolution, but rather, requires further subsequent machining such as crossboring of the post.

The U.S. Pat. No. 2,961,260 shows a continuous friction arrangement where balls wedge against a tapered portion of the chair shaft so that the seat may be raised, but when weight is placed on the seat, the balls wedge more tightly and prevent the seat from lowering. With such a continuously adjustable arrangement, the seat must be completely raised before it can again be lowered. It would be desirable to be able to raise the seat in this way without the need for completely raising it prior to lowering the seat.

Among the several objects of the present invention may be noted the provision of a precision grooved shaft for an adjustable chair support which is formed completely as a solid of revolution about a central axis requiring no further machining; the provision of a lock pin uniquely suited to function in conjunction with the shaft of the previous object; the provision of a sleeve through which the precision grooved shaft moves, the sleeve functioning as a side thrust bearing, providing a close tolerance fit with the shaft and limiting upward chair seat movement; and the provision of an economical and reliable adjustable height seat support arrangement.

These as well as other objects and advantageous features of the present invention will be in part apparent and in part pointed out hereinafter.

In general, a vertically adjustable seat support arrangement for a chair, stool or the like has a lower base or pedestal which may be either fixed or on casters, and an upper seat adjustably connected to the base by a vertical elongated tubular member having a lower end fixed to and supported by the pedestal and an elongated support post telescopically received within and vertically movable relative to the tubular member. The support post has an upper end fixed to the seat. A manual locking mechanism includes a locking pin selectively movable transversely between a post locking position where the pin extends through a sidewall of the tubular member and engages the post and a post releasing position where the post may be moved vertically relative to the tubular member. A spring biases the locking pin urging it toward the post locking position, and a lever is provided for moving the locking pin against the spring bias to free the post allowing vertical seat adjustment relative to the pedestal. The support post is formed as a symmetrical solid of revolution about a central axis. A sleeve through which the post passes is fixed within the tubular member serving as a side thrust bearing and preventing upward movement of the post beyond a predetermined maximum seat elevation and to provide a close tolerance fit between the post and the tubular member. Locking pin motion under the control of a lever and cam is limited to rectilinear motion toward and away from the post to insure proper interengagement between the pin and post.

BRIEF DESCRIPTION OF THE DRAWING

Corresponding reference characters indicate corresponding parts throughout the several views of the drawing.

Figure 1:
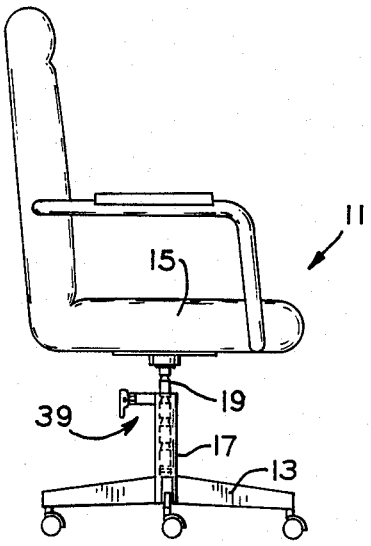
FIG. 1 is a side elevation view of an adjustable height chair incorporating the present invention in one form.

The exemplifications set out herein illustrate a preferred embodiment of the invention in one form thereof and such exemplifications are not to be construed as limiting the scope of the disclosure or the scope of the invention in any manner.

DESCRIPTION OF THE PRFERRED EMBODIMENT

Referring to the drawing generally, a vertically adjustable seat support arrangement is illustrated for a chair 11 with a lower pedestal 13 and an upper seat portion 15. The seat support arrangement including a vertical elongated tubular member 17 having a lower end fixed to and supported by the pedestal as by welding. An elongated support post 19 is formed as a symmetrical solid of revolution about a central axis 21. The support post 19 is telescopically received within and vertically movable relative to the tubular member 17. The support post has an upper end fixed to the seat 15 by a "C" shaped snap ring 23 which engages a circular groove in the upper portion of the post 19. A nylon washer 67 rests on a steel washer 68 which in turn rests on an annular ledge of the post 19. A nylon bushing 65 is interposed between the snap ring 23 and washer 67. The opposite or lower post end has a similar circular groove for receiving a similar snap ring 25 which functions to fix a washer-like member 27 of greater diameter than the shaft 19 to the lower end of shaft 19. Washer 27 engages the lower end of sleeve 29 as the seat is raised to prevent the seat 15 from being raised too far. This washer also provides alignment of the post 19 within the tubular member 17.

The support post 19 is a solid of revolution, hence, the several grooves such as 31 and 33 are annular completely encircling the post. In a typical implementation of the present invention, the grooves are axially spaced about one inch from one another and of an approximate depth of about 0.150 inches. Each groove has a sloping frustoconical surface such as 35 and a flat annular surface such as 37 extending in a generally horizontal plane perpendicular to the axis 21. Typically, the surface 35 will be inclined at about twenty degrees to the axis 21. A locking mechanism 39 includes a locking pin 41 having a sloping surface 43 which matches the slope of surface 35. This locking pin is selectively movable transversely between a post locking position as in FIG. 2 where the pin extends through a sidewall of the tubular member 17 and engages the post 19 and a post releasing position as in FIG. 3 where the post may be moved vertically relative to the tubular member. There is a sleeve 29 through which the post passes with this sleeve being fixed as by welding within the tubular member serving as a side thrust bearing and preventing upward movement of the post beyond a predetermined maximum seat elevation. The sleeve also provides a precision fit with the post 19. Sleeve 29 and the transversely extending locking mechanism housing 69 may both be joined to the tubular member 17 by a common weld as at 71.

Figure 2:
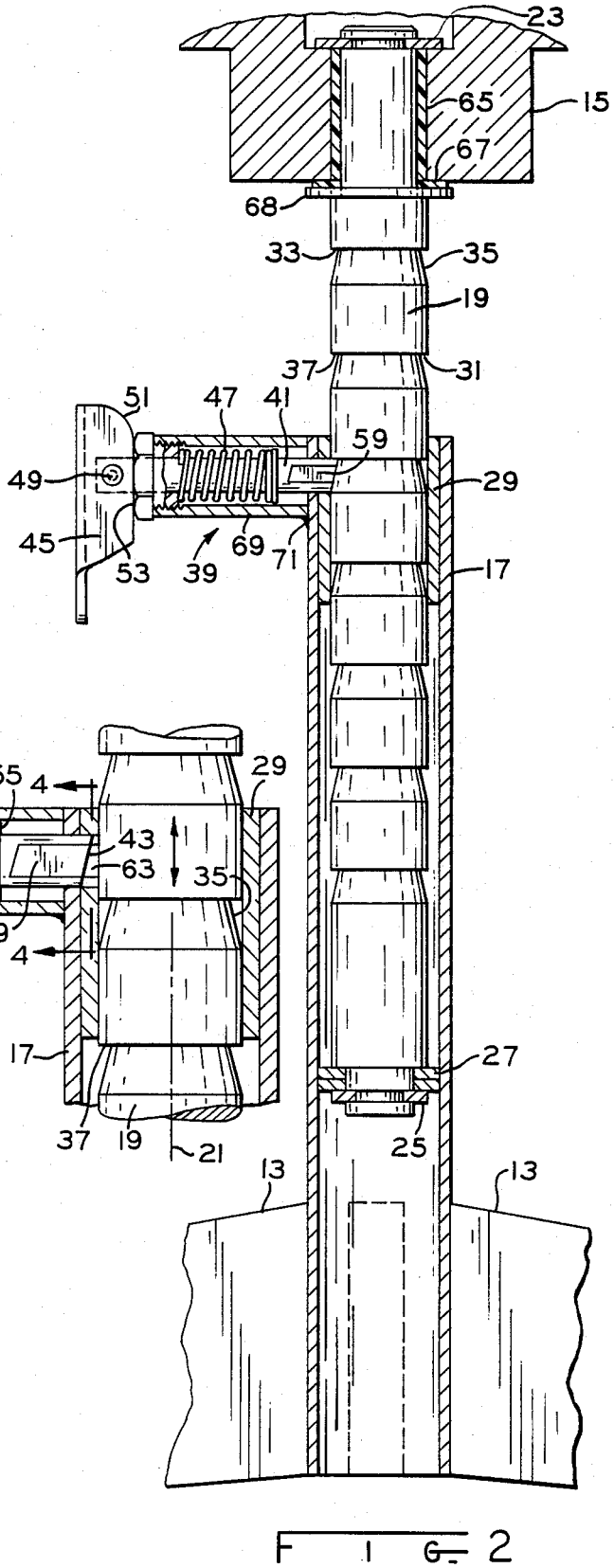
FIG. 2 is a view in cross-section of the adjustable seat support portion of the chair of FIG. 1.
Figure 3:
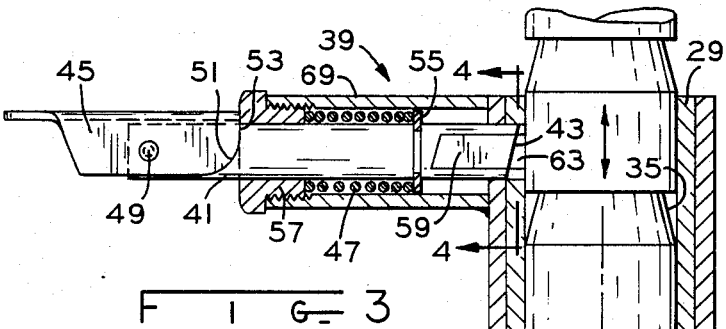
FIG. 3 is an enlarged cross-sectional view of the locking mechanism, support post and tubular member of FIG. 2.

A coil spring 47 provides a bias for urging the locking pin toward the post locking position and a lever 45 is pivotally attached to the locking pin at 49 so that as the lever 45 is moved from the position of FIG. 2 to that of FIG. 3, the cam surface 51 engages the end 53 of the locking mechanism 39 pulling the locking pin against the spring bias to free the post allowing vertical seat adjustment relative to the pedestal. Cylindrical alignment of the coil spring 47 is maintained by a close fit about the locking pin and compression of the spring 47 is between a "C" shaped snap ring 55 on the locking pin and the hollow plug 57.

Figure 4:
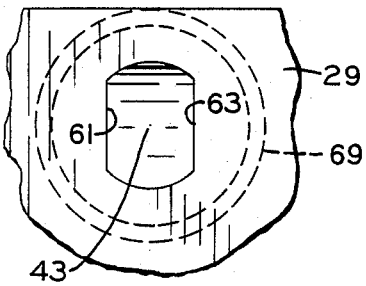
FIG. 4 is a view along lines 4—4 of FIG. 3.

It is important that the orientation of the locking pin be maintained so that the sloped face or surface 43 mates with the taper 35 of one of the annular notches or grooves 31. Thus, the locking pin motion should be limited to rectilinear motion toward and away from the post. This is accomplished by providing the locking pin with a region where the cross-section is not circular and providing a similarly non-circular hole such as the D-section of FIG. 4 within which the locking pin reciprocates. As shown, there are a pair of flat surfaces 59 ground on the opposite sides of the locking pin and, as seen in FIG. 4, a corresponding non-circular D-section hole matching flat edges 61 and 63 is punched in the sleeve 29 and/or in the tubular member 17.

When the stool or chair is in use, the spring loaded locking pin 41 selectively engages one of the annular grooves such as 31. The shape of the grooves is such as to allow the seat to be raised without the need for actuation of handle 45 and the locking pin to be cammed outwardly along surface 35. The surface 37 is horizontal so that no such camming occurs due to downward pressure on the seat. The shaft 19 is free to rotate within the base tube 17 and the seat 15 may be free to rotate about nylon bushing 65 between nylon washers 66 and 67.

In operation, the user grasps handle 45, moving it from the position of FIG. 2 to that of FIG. 3 freeing the seat to be lowered. The seat may be raised in the same way, or the user may merely exert upward pressure on the seat and the sloped surfaces 35 and 43 cooperate to withdraw the locking pin allowing the seat to move upwardly relative to the base.

From the foregoing, it is now apparent that a novel adjustable chair support arrangement employing a new support shaft which is economical, strong and adaptable to a wide variety of chairs and stools along with a unique locking mechanism therefor have been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. A vertically adjustable seat support arrangement for a chair, stool or the like having a lower pedestal, and an upper seat, the seat support arrangement including a vertical elongated tubular member having a lower end fixed to and supported by the pedestal, an elongated support post formed as a symmetrical solid of revolution about a central axis, said support post telescopically received within and vertically movable relative to the tubular member, the support post having an upper end fixed to the seat, a locking mechanism including a locking pin selectively movable transversely between a post locking position where the pin extends through a sidewall of the tubular member and engages the post and a post releasing position where the post may be moved vertically relative to the tubular member, the support post including a plurality of axially spaced frustoconical grooves for receiving one end of the locking pin when the locking pin is in a post locking position, and the locking pin including a sloped surface which matches the slope of the frustoconical grooves, spring bias means for urging the locking pin toward the post locking position, and a lever for moving the locking pin against the spring bias to free the post allowing vertical seat adjustment relative to the pedestal.

2. The arrangement of claim 1 wherein the locking mechanism includes a handle pivotably attached to the locking pin and having a cam surface for moving the locking pin to the post releasing position when the handle is pivoted.

3. The arrangement of claim 1 wherein the tubular member is provided with a non-circular hole and the locking pin has a region with a corresponding non-circular cross-section passing into the hole thereby preventing rotation of the locking pin.

4. The arrangement of claim 1 further comprising a sleeve through which the post passes, the sleeve fixed within the tubular member for preventing upward movement of the post beyond a predetermined maximum seat elevation.

5. A vertically adjustable seat support arrangement for a chair, stool or the like having a lower pedestal, and an upper seat, the seat support arrangement including a vertical elongated tubular member having a lower end fixed to and supported by the pedestal, an elongated support post formed as a symmetrical solid of revolution about a central axis, said elongated support post being telescopically received within and vertically movable relative to the tubular member, the support post having a circular groove in an upper portion for facilitating joinder of the support post and the seat, a C-shaped snap ring for engaging the circular groove whereby the support post may be fixed to the seat, a locking mechanism including a locking pin selectively movable transversely between a post locking position where the pin extends through a sidewall of the tubular member and engages the post and a post releasing position where the post may be moved vertically relative to the tubular member, a sleeve through which the post passes, the sleeve fixed within the tubular member providing a side thrust bearing and preventing upward movement of the post beyond a predetermined maximum seat elevation, spring bias means for urging the locking pin toward the post locking position, and a lever for moving the locking pin against the spring bias to free the post allowing vertical seat adjustment relative to the pedestal.

6. The arrangement of claim 5 further comprising means for limiting locking pin motion to rectilinear motion toward and away from the post.

7. The arrangement of claim 6 wherein the tubular member is provided with a non-circular hole and the locking pin has a region with a corresponding non-circular cross-section passing into the hole thereby preventing rotation of the locking pin and limiting the locking pin motion to rectilinear motion toward and away from the post.

8. The arrangement of claim 5 wherein the locking mechanism includes a handle pivotably attached to the locking pin and having a cam surface for moving the locking pin to the post releasing position when the handle is pivoted.

9. The arrangement of claim 5 wherein the support post includes a plurality of axially spaced frustoconical grooves for receiving one end of the locking pin when the locking pin is in a post locking position.

10. A vertically adjustable seat support arrangement for a chair, stool or the like having a lower pedestal, and an upper seat, the seat support arrangement including a vertical elongated tubular member having a lower end fixed to and supported by the pedestal, an elongated support post telescopically received within and vertically movable relative to the tubular member, the support post being formed as a symmetrical solid of revolution about a central axis and having an upper end fixed to the seat, a locking mechanism including a locking pin selectively movable transversely between a post locking position where the pin extends through a sidewall of the tubular member and engages the post and a post releasing position where the post may be moved vertically relative to the tubular member, the locking mechanism including a handle pivotably attached to the locking pin and having a cam surface for moving the locking pin to the post releasing position when the handle is pivoted, the support post including a plurality of axially spaced frustoconical grooves for receiving one end of the locking pin when the locking pin is in a post locking position, spring bias means for urging the locking pin toward the post locking position, the handle comprising a lever for moving the locking pin against the spring bias to free the post allowing vertical seat adjustment relative to the pedestal, means for limiting locking pin motion to rectilinear motion toward and away from the post, and a sleeve through which the post passes, the sleeve fixed within the tubular member for preventing upward movement of the post beyond a predetermined maximum seat elevation and providing a side thrust bearing for the post.

* * * * *